United States Patent [19]

Egtvedt et al.

[11] 3,965,832

[45] June 29, 1976

[54] METHOD OF CONTOUR SEWING

[75] Inventors: Robert B. Egtvedt, Comstock Park; Theodore C. Zwiep, Grand Rapids; John R. Den Bleyker, Holland, all of Mich.

[73] Assignee: Wolverine World Wide, Inc., Rockford, Mich.

[22] Filed: Nov. 20, 1974

[21] Appl. No.: 525,737

Related U.S. Application Data

[62] Division of Ser. No. 339,776, March 12, 1973, Pat. No. 3,871,306.

[52] U.S. Cl. ..... 112/262

[51] Int. Cl.[2] ..... D05B 1/00

[58] Field of Search ..... 112/121.11, 121.12, 112/121.15, 204, 205, 212, 213, 207, 206, 262

[56] References Cited

UNITED STATES PATENTS

| | | | |
|---|---|---|---|
| 3,094,087 | 6/1963 | Thorne | 112/206 |
| 3,557,727 | 1/1971 | Heimann | 112/121.12 |
| 3,650,229 | 3/1972 | Rovin | 112/121.11 |
| 3,693,561 | 9/1972 | Hrinko et al. | 112/121.11 |

*Primary Examiner*—George H. Krizmarich
*Attorney, Agent, or Firm*—Price, Heneveld, Huizenga & Cooper

[57] ABSTRACT

Apparatus as for use on a sewing machine, employing a stock pivoting and advancing platform for directionally guiding while advancing stock relative to a reference point during performance of an operation on said stock, the operation being therefore in a controlled pattern. Normally, a working tool such as a stitching needle, is at the reference point. The stock is incrementally advanced while repeatedly and incrementally being pivoted by the special platform in response to sensing of the pattern such as an edge of the stock. In use on a sewing machine, both the advancement and the pivoting are conducted while the stitching needle penetrates the material.

1 Claim, 22 Drawing Figures

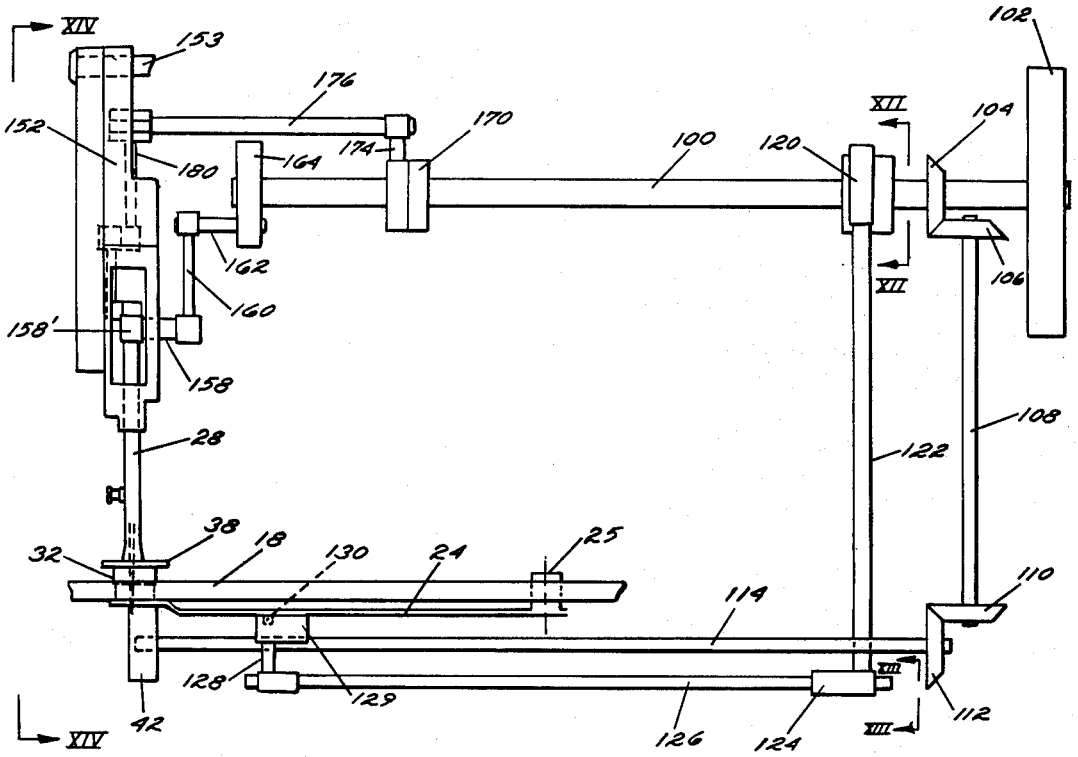
FIG. 11.
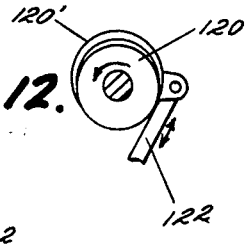
FIG. 12.
FIG. 13.
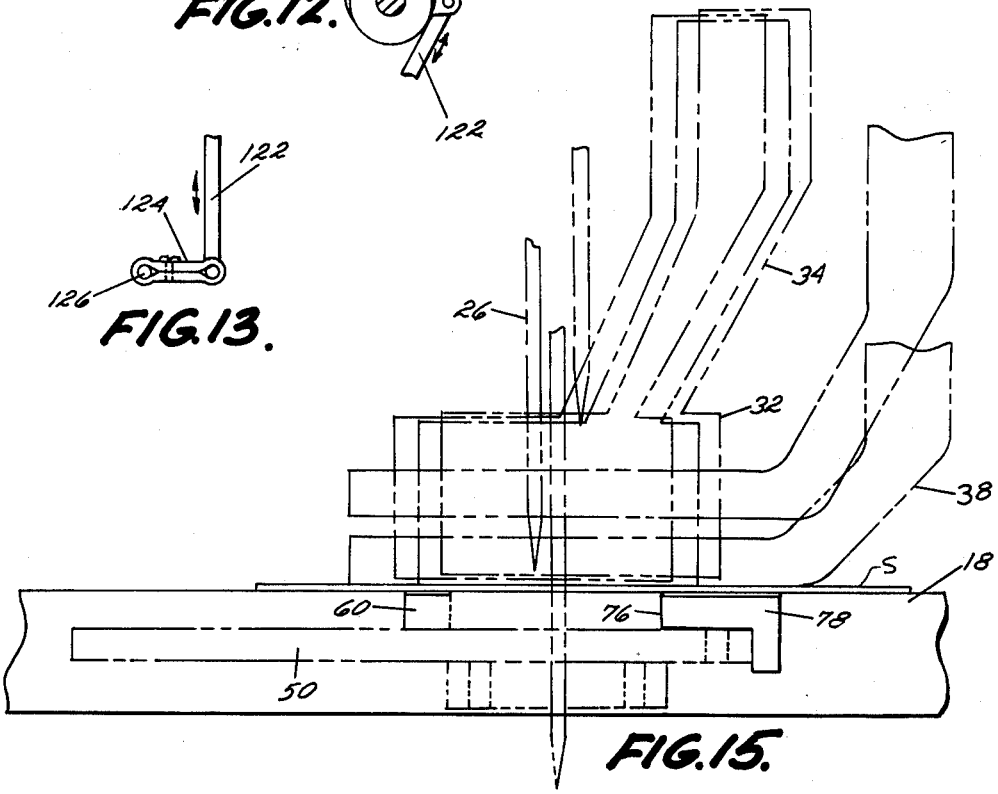
FIG. 15.

FIG. 17. A.

METHOD OF CONTOUR SEWING

CROSS REFERENCE TO RELATED APPLICATION

This is a division of application Ser. No. 339,776, filed Mar. 12, 1973, now U.S. Pat. No. 3,871,306.

BACKGROUND

This invention relates to apparatus for guiding stock past a reference point according to a pattern, and particularly advancing stock to a working tool, such as a stitching needle or other tool, while sensing the pattern on the stock incrementally and pivoting the stock in incremental fashion while the stock is also incrementally advanced.

Apparatus has been proposed in the past to feed stock such as sheet material past a working tool such as a stitching needle at a reference point, while controlling the orientation of the stock to follow a pattern such as an edge contour. A typical application of this principle would be the stitching of shoe leather as along a vamp, at a certain distance from the edge thereof. In fact, several different types of apparatuses have been proposed for doing this. As far as is known, none of these has really constituted a practical alternative to the age-old manual control technique, however, except possibly for recent proposals utilizing computer technology. The products resulting from the manual technique of course are only as good as the individual skill or lack of skill, of each operator. Further, the potential output is limited. And, while recent computer type proposals have potential for those organizations that can justify a highly sophisticated and very expensive installation, such proposals really are not practical or feasible for many operations or facilities, as is typical at smaller companies, e.g. pattern stitching of shoe materials or the like by smaller shoe manufacturers.

In the manufacture of leather or simulated leather goods such as shoes and gloves, installation of highly complex equipment is not really possible except in the giant corporations of the industry. Of course, the smaller businesses are the ones most in need of automation equipment to effectively compete. For this to occur, however, it is necessary for the equipment to be highly effective but relatively simple and inexpensive. Hence, it would be highly desirable to be able to convert conventional stitching or sewing machines from manual guidance to automated pattern guidance, at a small cost and ease of conversion.

SUMMARY OF THE INVENTION

It is an object of this invention to provide a relatively simple, highly effective apparatus for automatically feeding stock on a pattern basis to a reference point. The stock is incrementally pivoted about the reference point on a special platform which also incrementally advances the stock material relative to the reference point.

Another object of this invention is to provide a novel pivotable and reciprocable disc platform mechanism and supplemental gripping means for incremental feeding and incremental rotating of stock material to enable a pattern such as a groove or edge to be followed by a working tool. The disc platform reciprocates linearly on a repeat basis for the feed action, and reciprocates rotationally in varying but controlled amounts for the pattern following action.

Another object of this invention is to provide a disc platform that reciprocates linearly and reciprocates rotationally for pattern feeding, is biased from a reference position to a pattern sensing position for each infeed stroke, and is repeatedly forcefully returned to the reference position while engaging and incrementally turning the stock. The platform is released from the stock during the pattern sensing biased shift and engages the stock during the return stock-turning shift. The platform disc is specially configurated with offset portions engaged by return means that forcefully returns it to the reference position. In the preferred embodiment of a stitching or sewing machine, the needle is engaged with the stock or material both during the incremental material advancing function and during the incremental material pivoting function.

These and other objects, advantages, and features of the invention will be apparent from the following specification and drawings.

BRIEF DESCRIPTION OF THE DRAWINGS

FIG. 11 is a side elevational view of the main functional components of the sewing machine environment depicted;

FIG. 12 is a sectional view taken on plane XII—XII of FIG. 11;

FIG. 13 is an end view taken on plane XIII—XIII of FIG. 11;

FIG. 15 is an enlarged fragmentary elevational view of the stitching area of the apparatus, showing the sequential positions of the components during operation thereof;

FIGS. 17*a*, 17*b*, 18, 19*a*, 19*b*, and 20 are elevational and plan views of a schematic nature showing the sequential positions of the most significant components of the apparatus during various stages of operation, with FIG. 17 being specifically an elevational view of the components prior to operation upon the material or stock, FIG. 17*b* being a plan view showing the pivotal D-shaped disc and its reference stop correlating to the apparatus in FIG. 17*a*, FIG. 18 being an elevational view showing the stock being clamped by the D-shaped disc and the overlying cooperative clamping pressure disc, FIG. 19*a* being an elevational sectional view showing the material being incrementally advanced and rotated, FIG. 19*b* being a plan veiw of the disc and reference stop during the condition in FIG. 19*a*, and FIG. 20 being an elevational sectional view showing the advanced rotated stock having been clamped into restrained position with release and return of the D-shaped disc and cooperative pressure clamp to the initial position.

DESCRIPTION OF THE PREFERRED EMBODIMENT

Figure 1:
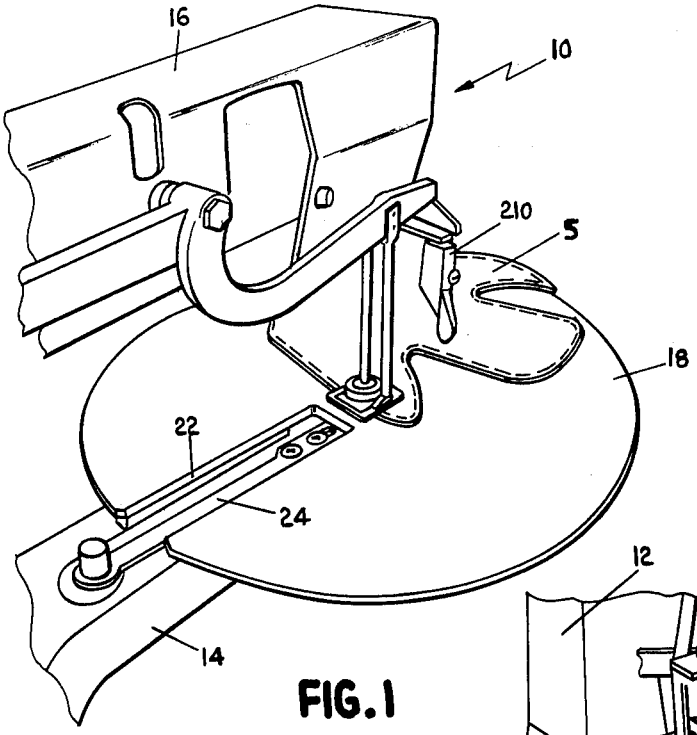
FIG. 1 is a perspective view of the invention, showing such in a sewing machine combination.

The illustrated embodiment of the invention depicts the inventive apparatus in a sewing machine combination. The apparatus initially was developed for this particular application and finds particular usefulness in such an application. However, those skilled in the art, once this disclosure is carefully reviewed and understood, will readily ascertain that the inventive apparatus can find utility in other types of apparatuses such as machine tools or the like, wherein stock or material is fed to a tool. Using the novel apparatus, such stock is incrementally fed or advanced and incrementally adjusted in orientation or direction of feed on a controlled pattern basis, using the edge of the material or some other predetermined pattern as the pattern reference.

Referring now specifically to the drawings and the depicted embodiment there illustrated, the sewing machine 10 is basically a conventional machine with certain components to be noted being substituted for certain conventional components. The particular machine depicted is a Pfaff Model 335, single needle cylinder bed sewing machine marketed by G. M. Pfaff AG, West Germany. Such a sewing machine conventionally has known mechanism for vertically and laterally reciprocating the needle, vertically and laterally reciprocating a walking pressure foot in synchronism with the needle, laterally reciprocating underside serrated feed dogs, vertically reciprocating a nonwalking pressure foot, and/or operating upper and lower bobbins.

The machine disclosed herein employs the conventional reciprocating stitching needle operated by the conventional drive means. The conventional throat plate has been replaced by a larger material support table with an upper work surface here shown to be circular in shape. The conventional upper walking pressure foot that ordinarily operates in combination with the underside feed dogs has been replaced by a preferred, freely rotatable, bearingmounted, walking pressure foot. It is operated by the conventional mechanism, however. The outer non-walking pressure foot that ordinarily clamps the material against the throat plate during the return stroke of the needle and walking pressure foot, has been replaced by one configurated differently to suit the other components in the assembly. It is operated by the conventional mechanism. And, most importantly, the lower feed dog has been replaced by a unique pivot platform device which performs three functions, feeding i.e. advancing the material in increments, orienting the material in its direction of advance in increments, and clamping the material during the incremental advance and incremental direction orientation, against the rotatable bearing pressure foot. This platform is vertically and laterally reciprocated by the same mechanism that reciprocated the substituted feed dogs, but it also has special rotary i.e. pivotal motions that result with its interaction with the stock. Each of these components will be explained in more detail hereinafter.

Figure 3:
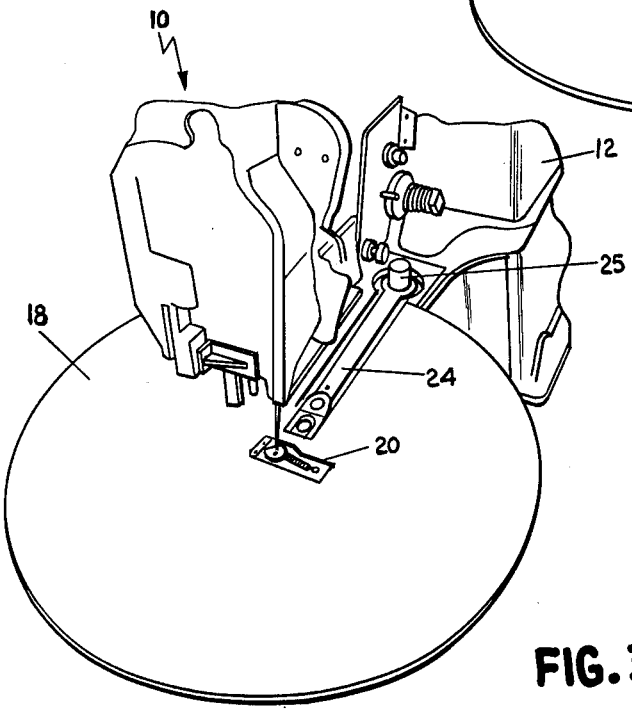
FIG. 3 is a perspective view of the apparatus in FIGS. 1 and 2, taken approximately from the 1 o'clock position in FIG. 2.

The sewing machine 10 has a conventional housing structure, including an upright column portion 12 (FIG. 3), a forwardly protruding base portion 14, and a forwardly protruding upper portion 16 spaced above and generally parallel to the base portion. On the outer end of this upper portion are mounted the needle support, the walking pressure foot support, and the non-walking pressure foot support. This housing structure and the housed mechanism (illustrated in FIGS. 11–14) are basically of conventional arrangement and construction except for the cmponents immediately at the stitching zone of the machine.

Figure 2:
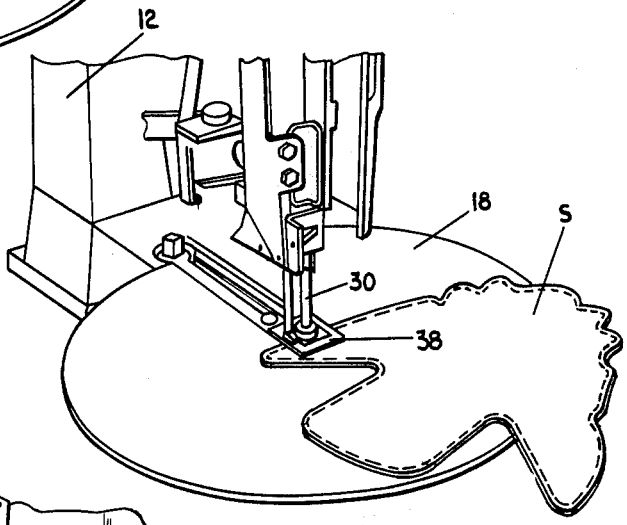
FIG. 2 is a perspective view of the apparatus in FIG. 1 taken from approximately the 2 o'clock position of FIG. 1.

The conventional, relatively small throat plate on base member 14 has been substituted by larger, generally circular table 18 which extends laterally outwardly peripherally from the needle stitching zone to provide a substantial support surface and turning surface for material or stock S (such as the shoe vamp illustrated in FIG. 2). This table can be coated with a lubricant such as "Teflon" for minimal frictional resistance to turning of the stock S. In the center of table 18 is an opening 20. Also, in the depicted version, an elongated slot 22 extends radially generally from the central region of the table to the peripheral edge, toward the upright column 12. Immediately below slot 22 is the conventional crank 24 which normally reciprocates the feed dogs beneath the throat plate of the sewing machine, but in this instance operates the novel material advancing and orienting device 60.

As will be understood, the reciprocating stitching needle 26 oscillates laterally during the vertical reciprocation, to enable the material being stitched to be advanced in increments past the needle. The term laterally as used herein means relative to the orientation of the elongated sewing machine elements 14 and 16, as is clear from the description and drawings herein, and such would be longitudinal relative to the direction of feed of the material being stitched. In a normal sewing machine, the inside pressure foot (i.e. immediately adjacent the needle) also oscillates laterally and reciprocates vertically in synchronism with the stitching needle, to hold the material against the feed dogs underneath the throat plate, as the material is penetrated by the needle and advanced incrementally during the stitch formation. In this novel machine, the stitching needle 26 and its mount 28 have not been altered from the conventional. However, the pressure foot normally mounted on mount 30 has been substituted by a freely rotatable pressure element 32, the leg 34 of which is attached to the mount 30. The rotatable nature of this walking pressure foot enables easy pivotal turning of stock gripped between this pressure foot and novel platform 60. The second, non-walking pressure foot 38 secured on mount 36 only reciprocates vertically without any lateral oscillation. Its function is the usual one of holding the material against the table 18 during movement of the needle and a first pressure foot and platform 60 back to the original position for another "bite" on the material. In this novel machine, pressure foot 38 is modified in configuration from the conventional so that it will not interfere with pressure foot 32 and the other components to be described. Foot 38 basically has a rectangular ring shaped configuration, or if desired some other configuration, the purpose being to obtain a good surface contact area for optimum holding of the material against the table 18 after the material has been advanced and during return movement of the needle and pressure foot 32 back to the initial position.

A pair of conventional bobbins are mounted on the machine, an upper bobbin (not shown) and a lower bobbin 42 (FIG. 14) beneath table 18 adjacent the needle. These bobbins operate in conventional fashion with the stiching needle.

The underlying crank arm 24 in base 14 beneath table 18 is conventional in construction. The serrated feed dogs conventionally mounted on its outer end at the stitching needle zone are replaced in this novel machine with a unique assembly. The conventional feed dogs serve one function, incremental advancement of the material being stitched in one direction past the stitching zone. If a directional change of the material is to be made during the stitching operation, it is made manually by the operator rotating the material between feed increments. The novel assembly, in contrast, in cooperation with the pressure feet and needle serves the multiple function of gripping the material, incrementally advancing the material relative to the stitching zone and also constantly incrementally changing in controlled fashion the directional orientation of the material being fed past the needle. Very significant is the fact that these multiple functions are performed by an extremely simple machanism which can be readily substituted for the feed dogs of a conventional sewing machine. In spite of the simplicity of the device, it functions in an automatic fashion to cause a sewing machine to follow the edge or other configurated pattern on the stock item such as the leather vamp of a shoe. This is just one example.

Figure 4:
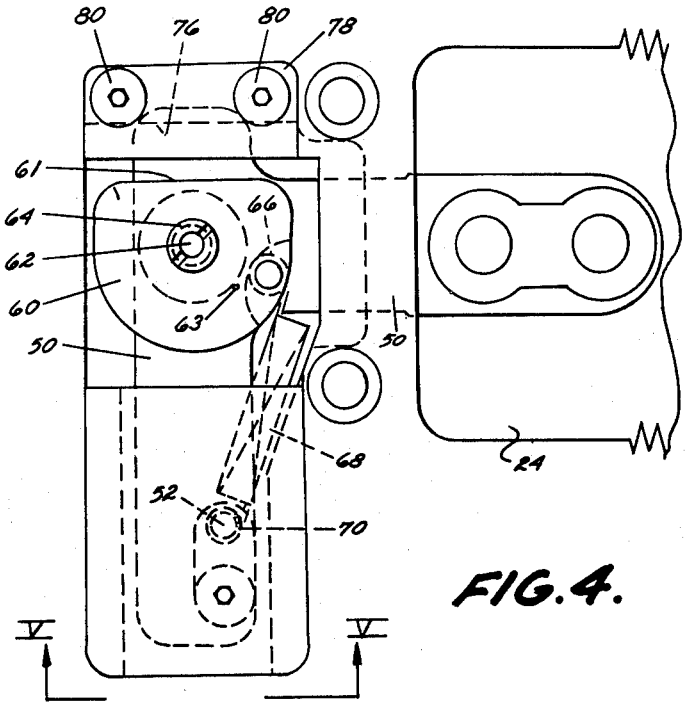
FIG. 4 is a fragmentary, enlarged underside view of the main novel elements in the stitching zone of the apparatus.
Figure 5:
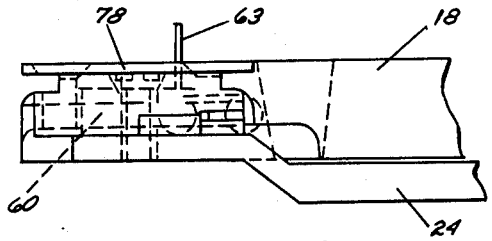
FIG. 5 is an elevational view taken in the direction indicated by the numerals V—V of FIG. 4.
Figure 9:
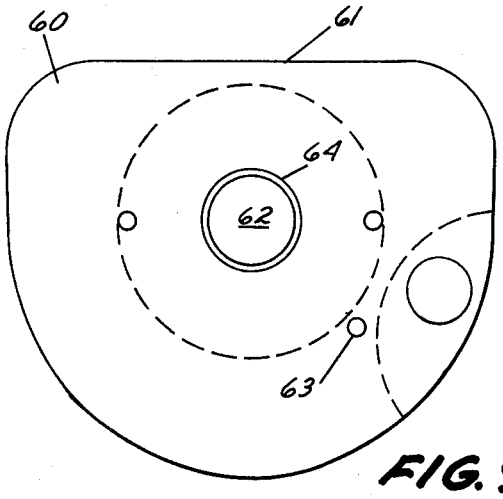
FIG. 9 is an enlarged plan view of the novel material feeding and rotating D-shaped disc member of the apparatus.
Figure 7:
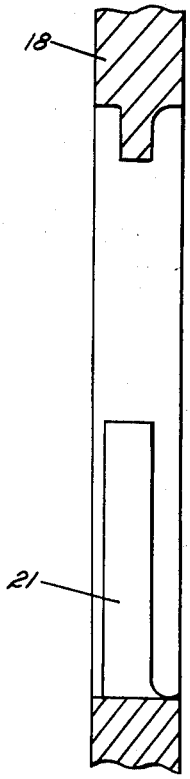
FIG. 7 is a sectional view taken on plan VII—VII of FIG. 6.
Figure 6:
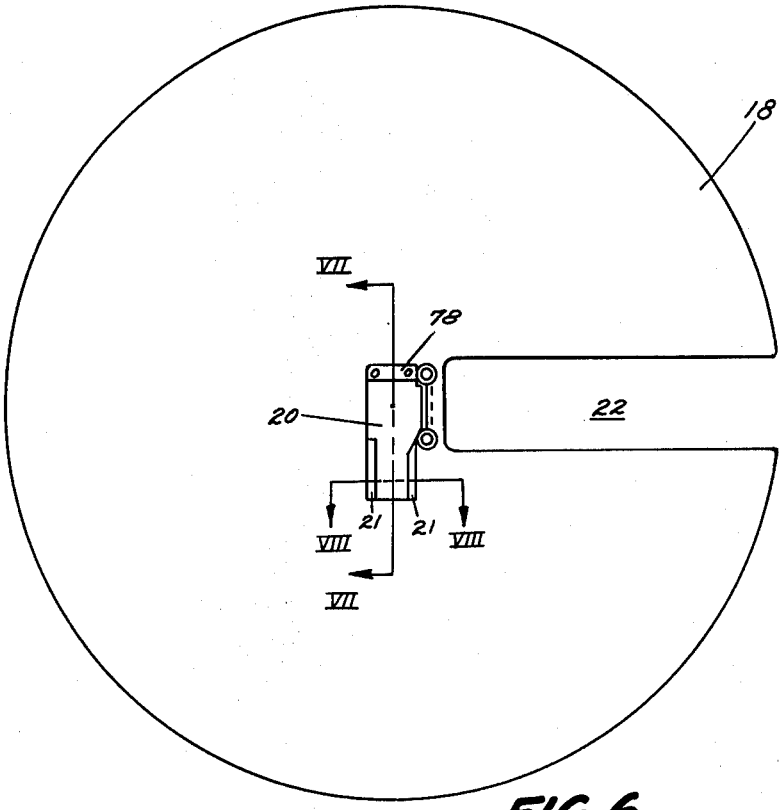
FIG. 6 is a fragmentary top plan view of the working table area of the apparatus of FIGS. 1–3.
Figure 8:
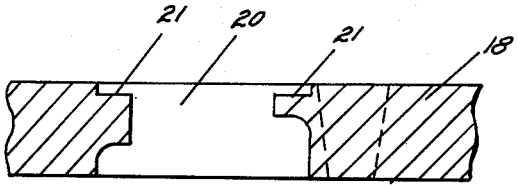
FIG. 8 is a sectional view on plan VIII—VIII of FIG. 6.
Figure 10:
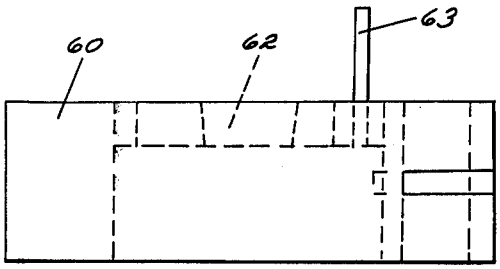
FIG. 10 is a side elevational view of the member in FIG. 9.
Figure 20:
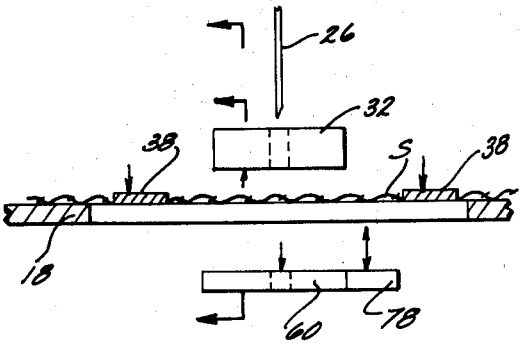
Figure 16:
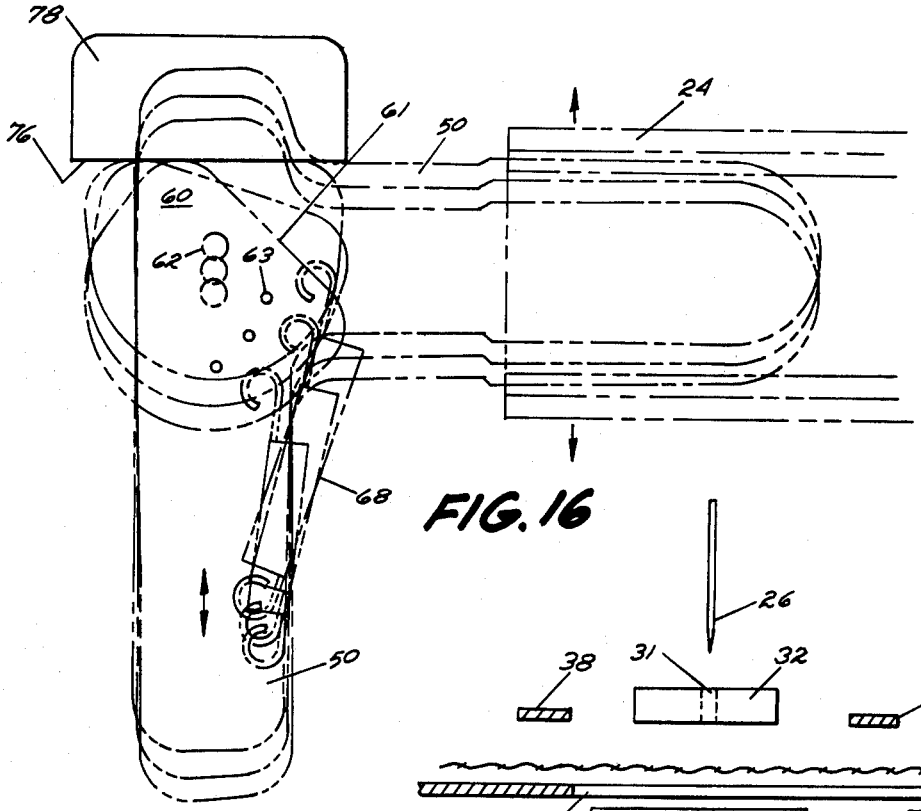
FIG. 16 is a plan view of the apparatus in FIG. 15 showing the components in sequential positions.

More specifically, attached to the end of crank 24 is feed arm 50 basically L-shaped in configuration. At the junction of the legs of this L-shaped member is pivotally mounted a D-shaped platform or disc 60. The disc is located below the needle. In the center of this disc 60 is an orifice 62 through which the stitching needle can pass during its vertical reciprocation. Disc 60 is also pivotally mounted on a vertical pivot axis coaxial with orifice 62 by means of an annular pin 64. Attached to one peripheral portion of disc 60 is one end 66 of a tension coil spring 68, the other end 70 of which is attached to a pin 52 on the extended end of L-shaped arm 50. This tension spring biases D-shaped platform 60 to a (clockwise) rotated position wherein the flat chordal edge or face 61 of platform 60 is at a substantial acute angle to the flat face 76 of a cooperative fixed reference stop 78 (FIG. 16). Reference stop 78 is attached by a pair of threaded fasteners such as screws 80 (FIG. 4) to table 18 at the end of elongated opening 20 adjacent the stitching zone. This opening is elongated in the direction of needle oscillation and stock feed. On the opposite end of this opening 20 from this reference stop 78, is a pair of cooperative slide type guide tracks 21 (FIG. 6) upon which the end portion of arm 50 rests during its reciprocation as caused by the lateral oscillation of crank 24. The successive movements of the crank and arm are depicted in FIG. 16. Extending upwardly from the upper flat surface of pivotal platform 60 is a protrusion or pin 63 which constitutes a sensing means to detect and engage the edge, for example, of material being stitched, and thereby control the angular rotation of the material or stock during the incremental feeding thereof. That is, engagement of this sensing means with the configurated pattern on the material, e.g. the edge of the material, determines the degree of angular rotation which this platform 60 is allowed under the bias of spring 68. This therefore determines the degree of rotation of the material and the platform in the opposite angular direction as platform 60 is again advanced and its flat surface 61 is caused to engage and be turned by reference flat surface 76 in a manner to be described in detail hereinafter.

The basic mechanical connections and drive sequences of the sewing machine depicted are directly comparable to those in a conventional sewing machine. Those illustrated in the drawings generally depict a Pfaff brand machine but some other conventional machine can be employed. The drive mechanism to the needle support 28 is conventional. The drive mechanism to the running pressure foot support 30 is conventional. The reciprocating drive to the secondary material restraining pressure foot support 36 is conventional. The drive mechanism which operates the novel material feeding and directional controlling platform 60 is the same conventional drive that operates the feed dogs in a conventional machine. However, to be sure that the invention in this combination is clearly understood, a brief description will be given relative to this drive mechanism which is basically depicted in FIGS. 11–14.

This mechanism includes a main drive shaft 100 having a fly wheel 102 at the rear end. A bevel gear 104 on shaft 100 meshes with another bevel gear 106 on shaft 108 which in turn drives a bevel gear 110 which engages with a bevel gear 112 for rotation of shaft 114 and of lower bobbin 42. Also attached to shaft 100 is an eccentric ring cam mechanism 120 (FIGS. 11 and 12) which reciprocates a connected crank 122. Crank 122 is attached by an offset 124 (FIG. 13) to a lower shaft 126. Rotational oscillation of shaft 126 also oscillates radial projection 128 which thereby laterally reciprocates crank 24 on its vertical pivot pin 25 by means of a pin connection 130 between crank 24 and boss 129 on the upper end of offset 128. Since the arc of movement of crank 24 has a substantially long radius, the oscillation through a small angle of this arc in effect gives almost a straight linear movement to member 50 and platform 50 mounted on the outer end thereof opposite pivot 25. This causes platform 60 to oscillate repeatedly toward and away from the fixed reference element 78.

Figure 14:
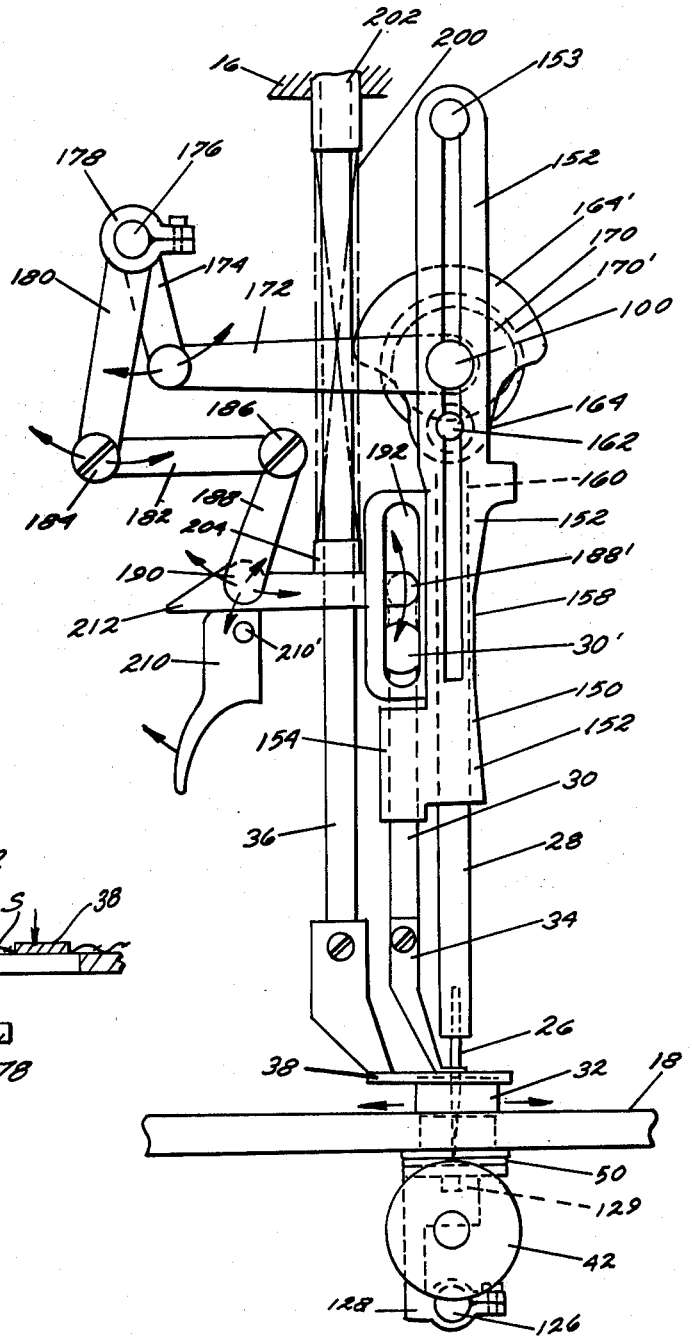
FIG. 14 is an end elevational view taken in the direction indicated by the arows XIV—XIV of FIG. 11.

The stitching needle 26 is vertically reciprocated by vertical reciprocation of its mount 28 in guide 150 (FIG. 14). Guide 150 forms part of a support 152 which also includes a guide 154 for the mount 30 of the walking pressure foot 32. Attached to the upper end of mount 28 by a collar 158' is a pin 158 (FIG. 11) forming part of a crank 160 having a pin 162 at its other end eccentrically carried by cam 164 attached to the end of drive shaft 100. Thus, rotation of shaft 100 and cam 164 causes pin 162 to move in a circular path for vertical reciprocation of crank 160 and link 158 and hence needle mount 28. Cam 164 has an arcuate counterweight 164' (FIG. 14) to balance it. The needle moves a substantial distance during this vertical reciprocation. Also reciprocating, but through less of a distance, is the adjacent walking foot support 30 in its guide 154. The mechanism that vertically reciprocates this mount 30 is also the same mechanism that oscillates the entire support 152 for the needle mount and walking foot mount in a lateral direction in synchronism with the oscillation of the underlying arm 50 and platform 60. This vertical reciprocation of the walking foot and the lateral oscillation of the walking foot and needle mounts are caused by another connection to drive shaft 100, specifically, eccentric cam 170 (FIG.11) similar to eccentric cam 120 (FIG. 12). These ring cams 170 and 120 have an internal eccentric (FIGS. 14 and 12) mounted on shaft 100 and a ring shaped cam follower 170' and 120' around the eccentric. Cam 170 oscillates link 172 (FIG. 14) along its length, this link in turn being pivotally connected to link 174 which is pivotally connected on shaft 176 in collar 178. Shaft 176 is rotatable but is fixed against lateral movement. Attached at one end to shaft 176 is another link 180, the lower end of which is pivotally connected at pin 184 to link 182 to oscillate it along its length. The opposite end of link 182 is connected through pin 186 to one end of an L-shaped link 188. The opposite end 188' of L-shaped link 188 is operably slidably associated with an elongated vertical slot 192 of the support 152. This free end 188' is also operably connected in a conventional fashion to the upper end element 30' of mount 30 for the walking foot. Element 30' is also in slot 192. Pin 190 at the bight of L-shaped link 188 mounts an abuttment 212 which cooperates in conventional fashion with finger operated lift cam 210 on its pivot 210' to lift the non-walking foot 38. Reciprocation of these links 172 through 188 as shown by the arrows in FIG. 14 under the influence of eccentric 170 causes link end 188' to move in an arcuate path which oscillates the entire support 152 about its upper pivot pin 153 (FIG. 11 and FIG. 14). Although this is an arcuate movement, since the radius of the arc from pin 153 down to the lower end of the needle and the walking foot is very substantial, the oscillation of the needle and walking foot is almost a straight line movement. Further, since link end 188' is operably connected to mount end 30', vertical reciprocation of the walking foot is in synchronism with this oscillation and is in synchronism with the vertical reciprocation of the stitching needle.

Actually the movement of L-shaped link 188 also operates the non-walking pressure foot 38, as will be explained, so that the movement of this foot is in synchronism with the other foot and needle. The mounting of this foot will now be explained.

Mount 36 has two spaced collars around it, namely collar 204 affixed to its central portion, and collar 202 slidably positioned around its upper end and attached to sewing machine housing 16. Collar 204 rests on the lower horizontal leg of L-shaped link 188. Also positioned around the upper portion of restraining foot mount 36 is a compression coil spring 200 retained between upper collar 202 and lower collar 204. This spring biases mount 36 and the restraining foot to a lowered condition. This restraining foot 38 is lowered with elevation of the stitching needle and walking foot, and alternately is raised with lowering of the stitching needle and walking foot. Its purpose is to hold the material in position when the walking foot and stitching needle are returning to get another bite on the material. Specifically, it will be seen that raising the lower horizontal leg of link 188 will raise collar 204 against the bias of spring 200 and also raise mount 36. To enable this to be understood, the movement of these elements will be described during lowering of the walking foot and raising of the restraining foot. Firstly, when cam 170 shafts link 172 to the left (as depicted in FIG. 14), this ultimately causes pin 186 to move to the right. The link 188 then tends to pivot about its bight, causing end 188' and element 30' to drop in slot 192 to lower mount 30 and foot 32. However, when foot 32 bottoms out and is pressing the stock against table 18, cam 170 shifts link 172 still further. Since pin 186 keeps moving to the right, link 188 tends to pivot around end 188' (see second set of arrows at point 190 in FIG. 14) which lifts the link, particularly its lower leg, thereby lifting collar 204, mount 36 and foot 38. This therefore assures that restraining foot 38 will be lifted after and only after foot 32 is in control of the stock by pressing it. Continued rotation of cam 170 eventually allows collar 204 and foot 38 to again be lowered at the end of the stitching stroke and stock advancement by lowering of link 188. After link 188 lowers, its end 188' raises in slot 192 with continued movement of cam 170 to lift foot 32. This cycle is repeated for each stitching stroke.

The conventional finger operated manual lift 210 engages link 212 for manual lifting of collar 24 and pressure foot 38 when initially feeding material to the sewing machine or removing it therefrom.

During operation, therefore, stitching needle reciprocates vertically while also being oscillated laterally to move with the incrementally fed material and then return. The needle is penetrated through the material during the incremental advance and is withdrawn from the material during the return. Also, the walking foot presses the material against rotational platform 60 during this needle penetration and material advance increment and is vertically retracted in its reciprocation during return with the withdrawn needle. The restraining pressure foot on the other hand is vertically retracted from the material after the needle penetration and walking foot pressing and just prior to incremental advance stroke, and moves down to clamp the material against table 18 just prior to needle retraction and during return of the needle and walking foot and return of the pivotal platform 60. These movements are illustrated shcematically in FIGS. 17*a*, 17*b*, 18, 19*a*, 19*b* and 20. Also depicted in these figures is the operation of the novel platform 60 during these motions.

Figure 17B:
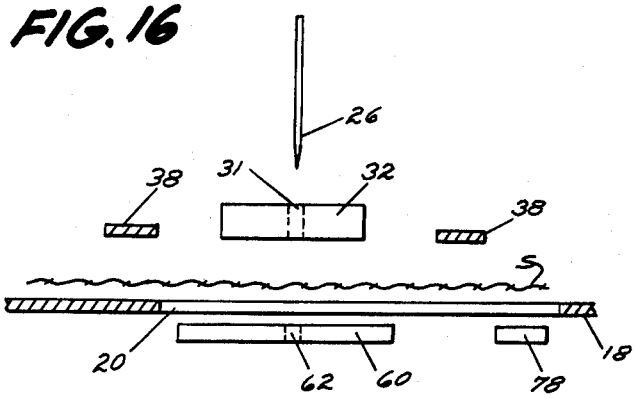
Figure 17B:
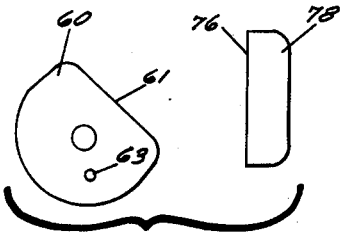
Figure 18:
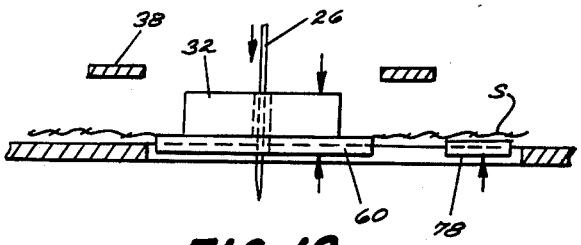
Figure 19B:
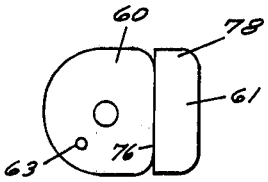
Figure 19A:
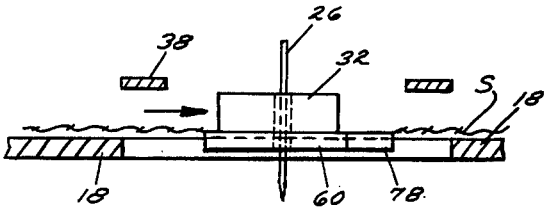

Initially, by manual manipulation of lever 210 (FIG. 14) restraining pressure foot 38 is elevated to enable a piece of material or stock S such as the shoe vamp illustrated in FIGS. 1 and 2 to be placed under the stitching needle, the needle and walking foot being positioned in an elevated condition by manual manipulation of fly wheel 102 of the sewing machine in conventional fashion. In this exemplary showing of stitching of shoe vamp, the vamp is to be stitched along a configurated pattern matching that of the vamp edge, at a controlled spacing from the edge, e.g. about one-fourth inch or so. With release of element 210, compression spring 200 of the restraining foot mount 36 is activated to enable the restraining foot 38 to press the material against the surface of platform 18. The machine is then ready to be activated, typically with an electric motor (not shown) to rotate the main drive shaft 100. This activates the stitching needle reciprocation and oscillation, the walking pressure foot reciprocation and oscillation simultaneously with the needle, and non-walking pressure foot reciprocation, the bobbins, and crank 24 which oscillates platform 60. Referring to FIGS. 17*a* and 17*b*, assuming the walking foot 32 and platform 60 are separated and the needle 26 is vertically upwardly withdrawn, and the restraining pressure foot 38 is not applied by lowering, and the novel platform 60 spaced away from its reference stop element 78, the needle and walking foot are next activated to the condition illustrated in FIG. 18. That is, walking foot 32 lowers to engage stock S against platform 60 while needle 26 lowers to penetrate the stock and move through orifices 31 and 62 respectively in the foot 32 and platform 60, (FIGS. 19*a* and 19*b* ) while also being oscillated toward the fixed reference stop 78 to cause the material to be advanced incrementally while the stitch is being formed. In addition, as platform 60 is advanced toward stop 78, it is initially retained in an angular condition (FIG. 16) so that its chordal flat face 61 is at an acute angle to the reference face 76 of stop 78, because of the tension of spring 68. Continued advancement causes one end of surface 61 to engage surface 76, followed by subsequent forced rotation of element 60 against the bias of spring 68 until face 61 fully abuts face 76 (FIG. 16) at the end of the advancing stroke. This rotation of platform 60 causes stock S which is gripped between platform 60 and rotatable foot 32 to also be forceably rotated a controlled amount depending upon the initial position of platform 60 at the start of the incremental feed stroke. Walking foot 32 therefore preferably constitutes a rotatable bearing member which will readily rotate with platform 60 with minimum rotational drag. The fairly large surface area of table 18 enables the stock to be held in a generally planar condition for minimum resistance to its rotation in incremental amounts with each advance of platform 60. At the end of this stitch forming stroke, restraining foot 38 lowers to grip the material S against table 18 followed by vertical withdrawal of stitching needle 26 and raising of walking foot 32. The stitching needle and walking foot then are oscillated back to the initial position for taking another bite on the material.

During this return movement, spring 68 will tend to rotate platform 60 about its central pivot point which is also coincident with the stitching needle. Whether or not platform 60 pivots under the bias of spring 68, and the amount of its pivoting is determined by the engagement of edge sensing pin 63 on the edge of the stock S being stitched. The pin is radially offset a small amount from the axis of the needle so that rotation of platform 60 causes pin 63 to move through an arc. Platform 60 will rotate under the bias of spring 68 until pin 63 engages the edge of the stock. The angular amount this platform is able to rotate under the influence of spring 68 will determine the angular amount which it will be forced to rotate in the reverse direction until its face 61 again engages stop 78. This therefore determines the amount of pivoting of the material which will occur during the next incremental feed stroke. Hence, if the curvature of the material edge is only slight, pin 63 will engage this edge almost immediately as platform 60 begins to withdraw from the stop, and the amount of subsequent rotation of the stock will be only a small amount to compensate for this curvature. In fact, if the edge is straight, pin 63 will engage the edge immediately as the platform beings to retract so that the stock will not be rotated at all. If the curvature is very large, on the other hand, platform 60 will rotate through a substantial angle before the pin engages the edge. The subsequent return rotation of the platform and of the material gripped thereon will then be substantial. If the material edge curves in the opposite direction, pin 63 will be in engagement with the material edge as platform 60 returns, causing the pin and platform to forceably be rotated in the opposite angular direction, i.e. as the unit is depicted, counterclockwise. Thus, subsequent advancing movement of the platform with the needle and engagement of face 61 with face 76 will rotate the platform and stock clockwise the correct amount. Hence, whatever the amount of curvature, and whatever the direction of curvature, the platform accommodates this and automatically compensates therefore in incremental amounts during the incremental feed steps. The direction of feed of the stock to the needle is therefore constantly controlled in increments on an automatic basis. This is achieved even though the device is extremely simple in nature. This sequence of steps is repeated very rapidly depending on the stitching speed, so that synchronous incremental directional control is achieved with incremental feeding of the stock to the needle. The directional turning occurs while the needle has penetrated the material and therefore the material pivots about the needle.

Extensive experimental operation of the apparatus has shown it to be completely effective on a variety of materials such as leather, polymers including synthetic leather, cloth, etc. It is also important, particularly with regard to small manufacturers, that conventional sewing machines can be readily modified to take advantage of the invention. By so doing, the material fed through the machine can be automatically controlled in its directional feed without requiring manual guidance thereof with its concomitant problems. The configuration, orientation, and/or location of the sensor could be altered to suit a particular type of material and/or operation.

It is also entirely possible that this principle can be applied to various other types of tools rather than just sewing machines, e.g. marginal cementing of the edge of leather, polymers, paper, metals, foam or solid rubber, etc; trimming of material relative to its edge and/or grooving, such as edge machining, to a template; laminating materials to an edge directly or indirectly through a template; stitching or otherwise combining of materials by the use of sewing machines; ultrasonic welding or high-frequency welding; marking as used for example in the shoe industry directly to the edge of the material or through templates; cutting or skiving of materials; pinking; perforating; eyeletting; little way channeling; scientific leather measuring; making of templates, dies, and patterns; milling; and others.

Further, it is possible to use different types of configurated pattern sensors rather than the simple sensor employed for detecting the edge of materials. For example, the novel apparatus has been combined with a pneumatic sensor using a dynamic air flow so that not only can the edge of a material be detected and responded to by the difference in the air flow rate, but also a groove or indentation in the material can be sensed and followed by causing the different air flow rates to activate a power unit to rotate platform 60 until the original flow rate on the sensor is restored. Of course, once the principle of this invention is understood, those having ordinary skill in the art will realize that various types of pattern sensors can be employed.

Hence, it is intended that this invention is not to be limited specifically to the particular illustrative embodiment set forth, but only by the scope of the appended claims and the reasonable equivalent thereto.

The embodiments of the invention in which an exclusive property or privilege is claimed are defined as follows:

1. A method of contour sewing material comprising the steps of:

repeatedly inserting a threaded stitching needle into the material at successive intervals to form a stitching pattern;

gripping and advancing the gripped material in increments, each increment of advancement occurring while the needle is inserted into the material and advances therewith from an initial position to a final position;

rotationally turning the gripped and advancing material in controlled increments simultaneously with said advancing of the material, each increment of turning and the simultaneously occurring increment of advancing occurring while the needle is inserted into the material and the material is gripped;

and each time after simultaneously advancing and turning the material, releasing the grip on the material, and withdrawing the stitching needle and returning the needle to said initial position.

* * * * *